US005597207A

United States Patent [19]

Bergsten et al.

[11] Patent Number: 5,597,207

[45] Date of Patent: Jan. 28, 1997

[54] ERGONOMIC ARM SUPPORT

[75] Inventors: Jeffrey D. Bergsten, Brooklyn Park; Donald A. Bergsten, Eden Prairie, both of Minn.

[73] Assignee: Industrial Ergonomics, St. Louis Park, Minn.

[21] Appl. No.: 326,825

[22] Filed: Oct. 20, 1994

Related U.S. Application Data

[63] Continuation-in-part of Ser. No. 141,196, Oct. 21, 1993, Pat. No. 5,369,805, which is a continuation-in-part of Ser. No. 755,432, Sep. 5, 1991, Pat. No. 5,281,001.

[51] Int. Cl.[6] ..... A47C 7/54

[52] U.S. Cl. ..... 297/411.35; 297/411.36; 297/411.37; 297/411.38; 297/411.23

[58] Field of Search ..... 297/411.2, 411.23, 297/411.24, 411.25, 411.26, 411.27, 411.28, 411.29, 411.3, 411.31, 411.35, 411.36, 411.37, 411.38; 248/118, 118.1, 118.3

[56] References Cited

U.S. PATENT DOCUMENTS

| | | | |
|---|---|---|---|
| 1,721,221 | 7/1929 | Jaurequi | 297/411 X |
| 2,704,114 | 3/1955 | Williams | 297/411.24 X |
| 4,332,263 | 6/1982 | Kitrell | 132/73 |
| 4,481,556 | 11/1984 | Berke et al. | 361/222 |
| 4,621,781 | 11/1986 | Springer | 248/118 |
| 4,688,862 | 8/1987 | Fowler et al. | 312/325 |
| 4,789,249 | 12/1988 | Mutolo | 384/43 |
| 4,815,862 | 3/1989 | Mugglestone et al. | 384/43 |
| 4,822,103 | 4/1989 | Stenvall | 297/411 |
| 4,997,054 | 3/1991 | Denny et al. | 297/412 X |
| 5,108,057 | 4/1992 | Dandy, III et al. | 248/118 |
| 5,143,422 | 9/1992 | Althofer et al. | 297/411 |
| 5,318,347 | 6/1994 | Tseng | 297/411.2 X |
| 5,388,892 | 2/1995 | Tornero | 297/411.2 X |

OTHER PUBLICATIONS

Linear Industries Ltd. catalog, pp. 1–72 of Section A, pp. 1–5, 32–37 of Section C, pp. 1–8 of Section D, copyright date of 1975, 1979.

Ergo Arm sit–rite brochure, four pages (unpaginated) undated.

Rini Ergoteknik ab brochure, two pages (unpaginated) 85–12–15.

Rini Ergoteknik ab brochure, two pages (unpaginateda) dated 1990.

Mabs arm brochure, three pages (unpaginated), undated.

THK literature, one page (p. 7) entitled guide Type SR . . . R/S undated.

THK literature, one page, (p. 48) entitled THK type DP, undated.

THk literature, one page (p. 122) entitled THK Ball Spline Type LMT, undated.

THK literature, one page (unpaginated) on epochal linear motion systems, undated.

(List continued on next page.)

*Primary Examiner*—Milton Nelson, Jr.

*Attorney, Agent, or Firm*—Palmatier, Sjoquist, Helget & Voigt, P.A.

[57] ABSTRACT

An ergonomic arm support for supporting the forearm during typing, keying, or assembly operations. The arm support includes an armrest pivotally mounted on a slide or a shroud for sliding the armrest to and away from a base which is secured to a table or chair. The slide or shroud is pivotally mounted in the base such that the armrest, which is pivotal relative to the slide or shroud and slidable to and away from the base, is also rotatable about the base to provide for a wide range of fluid motion for the forearm. The armrest further includes a plurality of roller bearing arrangements for facilitation of the slide or shroud and arm support. The roller bearing arrangements engage the slide or shroud proximate to the housing to provide for the fluid movement of the slide or shroud. A shroud may also be provided for enclosure of the roller bearing slide arrangement to prevent inadvertent engagement between an individual and/or the individual's clothes and the slide.

12 Claims, 14 Drawing Sheets

OTHER PUBLICATIONS

Unidentified literature, one page (p. 100) on spline shafts, undated.

Thomson Systems literature, one page (p. 31) "Double Shaft Unsupported System", undated.

LM76 Inc. literature, one page (unpaginated) "Ceramic Linear Motion Bearings", undated.

Pacific Bearing Co. literature, one page (unpaginated), "Linear Bearing Selection Guide", undated).

Power Trax literature, two pages (pp. 4,5) "Power–Trax Ball Splines" undated.

Pamphlet entitled "Relax Armrest" from rb form ab of Bodafors, Sweden, 4 pages.

"Moving Armrest" and Ergo Chair product information; Occupational Health & Safsety, Sep. 1991, p. 56.

The Mills TS Series Linear Slides, Catalog TS101–3 (14 pgs) MSP Mills Specialty Products 1991.

The Mills "EZ1" Series Linear Slides; Supplemental to Cat. No. EZ101–2 (Cat. No. EZ1SUP–1); MSP Mills Specialty Products 1992.

The Mills SE Series Linear Slides (SE Issue 3) MSP Mills Specialty Products 1992.

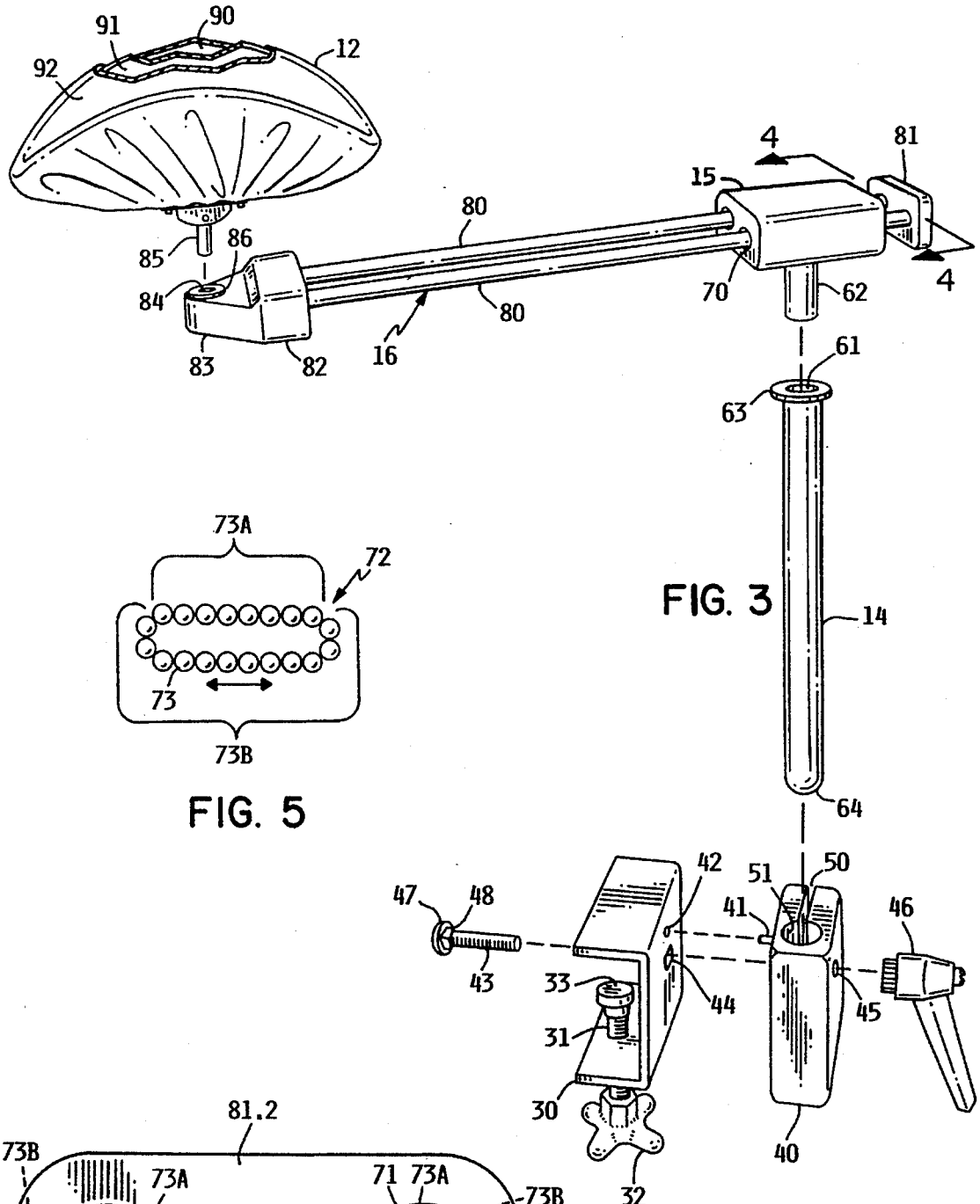
FIG. 3
FIG. 5
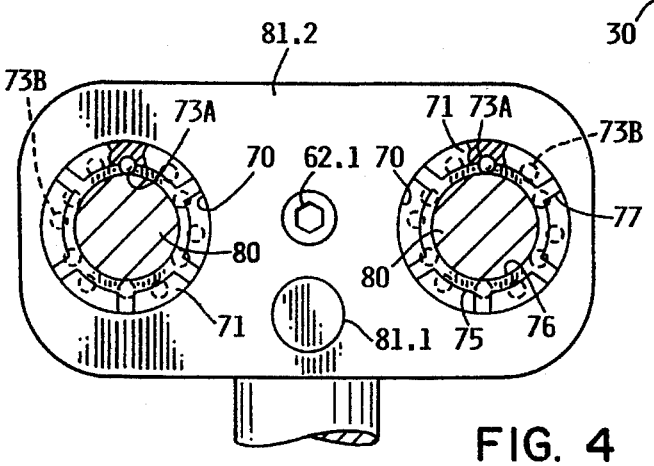
FIG. 4

ERGONOMIC ARM SUPPORT

The present invention is a continuation-in-part of application Ser. No. 08/141,196, filed Oct. 21, 1993, U.S. Pat. No. 5,369,805 issued Dec. 6, 1994, which is a continuation-in-part of application Ser. No. 07/755,432, filed Sep. 5, 1991, U.S. Pat. No. 5,281,001 dated Jan. 25, 1994, and relates to an arm support and, more particularly, to an arm support with a sliding armrest.

BACKGROUND OF THE INVENTION

Ergonomics may be defined as an engineering and physiological study of relationships between man and machines. An ergonomic device may be a device that is tailored to reflect human structure and function to, for example, enhance a person's ability to operate the device or an adjacent apparatus.

An ergonomic device may enhance a worker's performance or ability to operate a machine by relieving fatigue. For example, fatigue or repetitive motion disorders of the hand, wrist, and arm may be caused by repetitive or tedious hand, wrist, and arm functions. In the computerized environment, keyboard operators may spend their entire workdays at terminals with their forearms extended to their keyboards. Postal workers may spend long periods of time with their forearms extended to operate coding machines for coding and sorting mail. Assembly-line personnel may also work with their forearms extended over articles of manufacture to manipulate tiny parts with their fingers.

Ergonomic arm support devices have been designed for supporting the forearm of keyboard operators. Each of these devices typically consist of two arms with one arm secured to a desk and the second arm having a cushion at its distal end for supporting the forearm. These arms are frequently jointed at their connection, and also may be jointed at the forearm cushion and at the connection to the keyboard table for a total of three joints.

These jointed arm support devices have a number of problems. For example, the inclusion of two arms and three joints for a single device requires that the arm be secured to the keyboard table and positioned at a relatively great distance from the keyboard in order to provide sufficient space for mounting the jointed arm. Accordingly, a pair of such arm support devices may require a larger desk, and therefore may disadvantageously occupy a greater amount of work space. If the arm supports are in fact mounted closer to the terminal, the range of motion of each of the arm supports is limited, and the arm supports may dig into a worker's torso or interfere with his or her chair.

A similar problem concerns the impracticality of mounting the conventional jointed arm support on a chair. If this type of arm support is mounted on a chair, the long reach of its jointed two arms may interfere with access to the seat of the chair. Furthermore, the jointed arm support simply may not be reasonably operable on a chair because a chair, by its very nature, is drawn adjacent to the keyboard to a position in which the torso of the occupant of the chair or the keyboard may interfere with a range of motion of the second arm.

Another problem with the conventional jointed arm support is that it easily breaks when leaned upon. It is typical behavior for a worker to lean on the cushioned or distal end of the second arm of the conventional arm support which is intended for supporting only the weight of a forearm. The leverage or force exerted by the weight of such a lean or end loading is magnified by the overall length of the two arms of the jointed arm support.

Still another problem with the jointed arm support is that it is difficult to maneuver. For example, when one arm is aligned directly over the other arm, and the intended direction of movement of the forearm is in line with the two arms, the arms initially resist a pivoting relative to each other until the forearm exerts a force out of alignment with the two arms. Accordingly, such a conventional jointed arm support may not meet the definition of an ergonomic device that typically tracks or follows a natural movement of the human body without resistance.

Yet another problem is that the conventional two-arm jointed arm support may not decrease substantially the risk of carpal syndrome. This syndrome may be caused at least in part by the tendency of a keyboard operator to rest his or her wrists on the keyboard, or on a portion of the table immediately in front of the keyboard, while his or her hands are elevated relative to the wrists for operation of the keyboard. With the long reach of the two-arm jointed arm support, and the attendant amount of leverage, the arm cushion on the distal end of the second arm may sink to the table surface even under the relatively light weight of an arm. Even providing for height adjustment, such instability or deflection of the second arm may not provide a sufficient lift for the wrists to be held at the proper elevation relative to the hands to minimize the risk of carpal syndrome.

SUMMARY OF THE INVENTION

An ergonomic arm support for supporting the forearm during typing, keying, or assembly operations. The arm support includes an armrest pivotally mounted on a slide or a shroud for sliding the armrest to and away from a base which is secured to a table or chair. The slide or shroud is pivotally mounted in the base such that the armrest, which is pivotal relative to the slide or shroud and slidable to and away from the base, is also rotatable about the base to provide for a wide range of fluid motion for the forearm. The armrest further includes a plurality of roller bearing arrangements for facilitation of the fluid motion of the slide or shroud and arm support. The roller bearing arrangements engage the slide or shroud proximate to the housing to provide for the fluid movement of the slide or shroud. A shroud may also be provided for enclosure of the roller bearing slide arrangement to prevent inadvertent engagement between an individual and/or the individual's clothes and the slide.

An object of the present invention is to provide an arm support with fluid motion.

Another object of the present invention is to provide a strong and durable arm support.

A feature of the present invention is an arm support having an armrest for engaging a forearm, and a base for being secured to an object such as a table or chair, and a connection means between the armrest and the base that includes a slide for drawing the armrest to and away from the base in a sliding fashion.

Another feature is the engagement between the slide and the roller bearing means providing a fluid motion for the armrest.

Another feature is the provision in such an arm support, of the arm support comprising one arm to minimize any leverage exerted upon the armrest.

Another feature is the provision in such an arm support, of means for preventing rotation of the slide.

Another feature is the provision in such an arm support, of an elongate support fixed to, and extending from, the spindle of a chair for serving as a base for the arm support.

An advantage of the present invention is that fatigue may be reduced for workers such as keyboard operators or assembly line personnel. One of the features contributing to this advantage is the roller bearing means which provides a fluid motion to the armrest. Another feature contributing to this advantage is the lack of deflection or tilt of the slide or armrest even when leaned upon.

Another advantage is that the present invention may be mounted closer to the apparatus to be operated. The arm support may therefore occupy a minimal amount of space. One of the features contributing to this advantage is the provision of a slide between the armrest and the base. Another contributing feature is the provision of only one arm between the armrest and the base.

Another advantage is that the present invention has a high load capacity. It easily supports a great amount of weight on the armrest such as the weight of a worker leaning on the armrest or pushing herself or himself up and out of a chair via the arm supports. One of the features contributing to this advantage is the provision of only one arm between the armrest and the base. Another feature contributing to this advantage is the roller bearing means which may handle heavy end loading while providing for fluid motion.

Another advantage is that the present invention is ergonomic. The present arm support tracks or follows natural motion with minimal resistance.

Another advantage is that the present invention may be connectable to objects such as chairs, tables, table tops, wheelchairs, or machines.

Another advantage is that the present invention may be mounted close to the surface of a table top without engaging or abrading the table top even when a great amount of leverage is exerted on the armrest.

Another advantage is that the present invention aids in relieving back, neck, and muscle fatigue associated with holding an arm in an extended position.

Another advantage is that the risk of carpal tunnel syndrome may be minimized. One feature contributing to this advantage is the relative stability provided by the armrest mounted on the slide of the arm support, such that the forearm and wrist are maintained at the proper elevation relative to the hand.

Another advantage is that the slide arm may be easily shortened or lengthened to accommodate varying work areas.

Another advantage is the provision of a shroud for enclosing a housing containing the roller bearing means for protection of an individual and/or an individual's clothes from inadvertent pinching engagement to the housing and/or roller bearing means.

BRIEF DESCRIPTION OF THE DRAWINGS

FIG. 3 is an exploded perspective view of the arm support of FIG. 2.

FIG. 4 is a section view at lines 4—4 of FIG. 3.

FIG. 5 is a diagrammatic view of a recirculating ball bearing circuit utilized in the arm support of FIGS. 1 and 2.

DETAILED DESCRIPTION OF THE PREFERRED EMBODIMENTS

Figure 1:
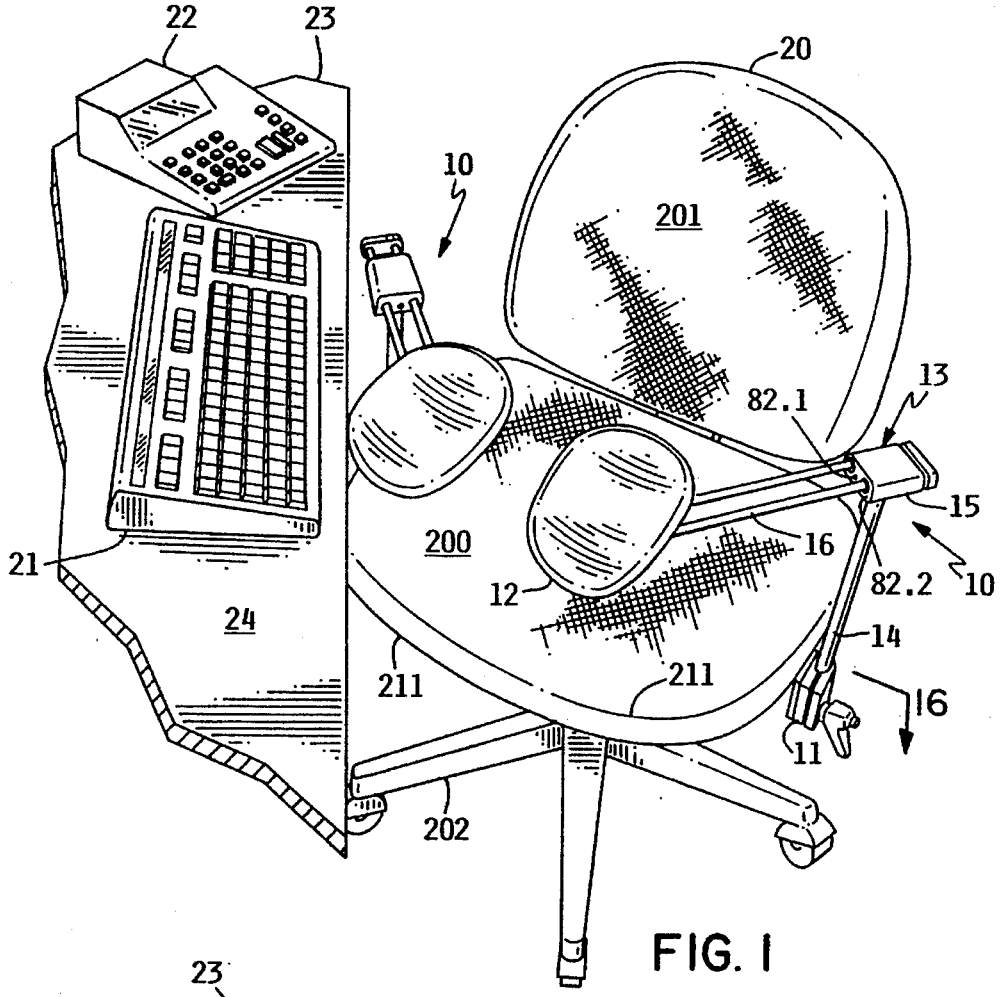
FIG. 1 is a perspective view of the present arm support mounted on a chair adjacent to a table with a keyboard and calculator.

As shown in FIG. 1, the present arm support is designated in general by the reference numeral 10 and includes as its principal components a base 11, an armrest 12, and a connection means 13 between the base 11 and the armrest 12. The connection means 13 includes a standard 14, a housing 15 with recirculating ball bearings, and a slide 16 slidable in the housing 15. The base 11 is connectable to a chair 20 via an elongate support affixed to the spindle of the chair 20. The armrests 12 engage and support the forearm and/or wrist for the operation of a keyboard 21 or calculator 22 which rest on a desk or table top 23 having a top surface 24.

Figure 2:
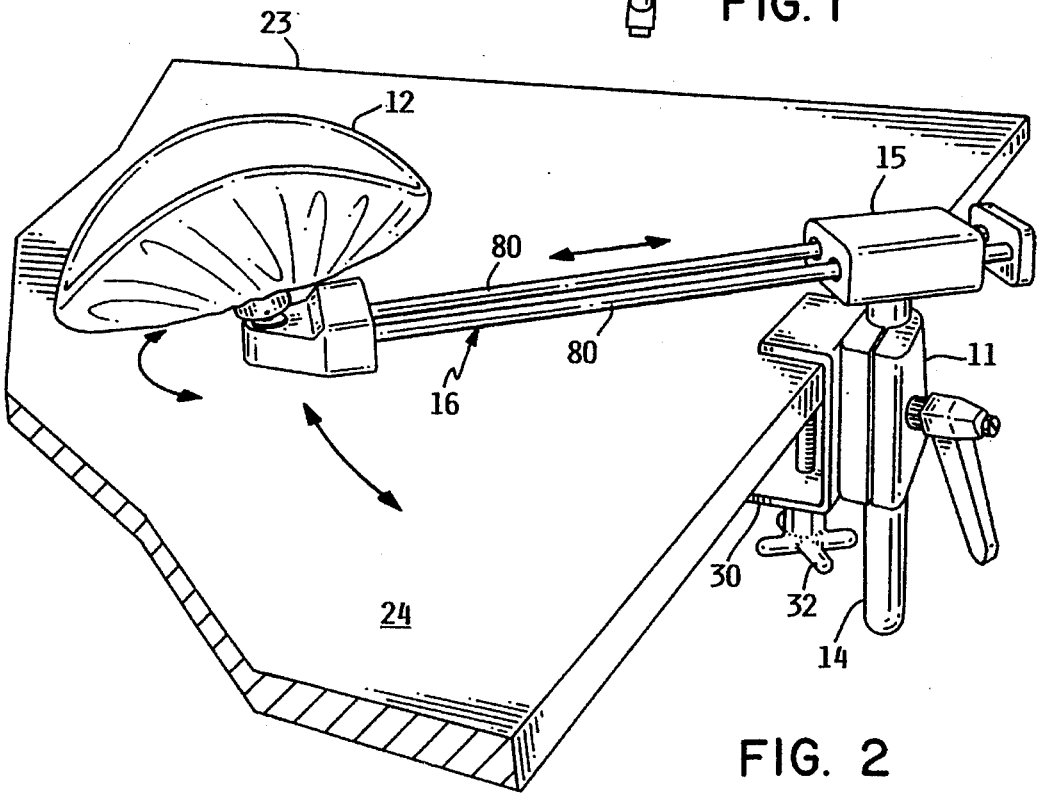
FIG. 2 is a perspective view of the arm support of FIG. 1 mounted on a table.

With more specificity, as shown in FIGS. 1, 2 and 3, the base 11 includes, if connectable to the desk 23, a generally U-shaped steel or aluminum clamp 30. The clamp 30 includes a threaded bolt 31 with a knob 32 fixed on one end and a pivotal and tiltable end piece 33 for engaging the underside of the desk top 23.

The base 11 further includes a slotted and apertured aluminum block 40 which is securable to the U-clamp 30. The block 40 includes a steel dowel pin or nub 41 for engaging an aperture 42 for alignment of block 40 relative to the U-clamp 30 and a threaded pin connector or carriage bolt 43 for being passed through respective apertures 44, 45 of the U-clamp and block 40, respectively, and engaging a threaded handle 46. The carriage bolt 43 includes a head 47 with a square portion 48 which locks into the inner portion of aperture 44 to prevent rotation of the pin connector 43 when tightened by the handle 46.

The block 40 further includes a vertical slot 50 communicating with a generally vertical standard-receiving hole 51. The aperture 45 and its respective pin connector 43 intersects the slot 50 such that the slot 50 is narrowed and the diameter of the apertures 51 is decreased when the handle 46 is tightened to squeeze the half portions of the block 40 together.

The connection means 13 includes the standard or post 14, which includes an axial seat 61 for seating a stem 62 depending from the housing 15. Seat 61 and stem 62 may be referred to as a joint. The seat 62 is fixed in a hole formed in the bottom of the housing 15 and is secured therein via a pin connector 62.1 as shown in FIG. 4. A flanged bushing 63 formed of a plastic with a low coefficient of friction such as TEFLON® or polytetrafluoroethylene material is disposed in the seat 61 for engaging the stem 62 for a fluid-like swinging or pivoting of the housing 15 relative to the standard. The flanged portion of the bushing 63 typically fluidly engages the underside of the housing 15. The standard 14 is vertically adjustable in the base 11 by tightening or loosening the handle 46 to pinch or disengage the standard 14 from the aperture 61. The standard 14 further includes a rounded closed bottom end 64. The stem 62 and standard 14 are typically formed of a cold rolled steel.

As shown in FIGS. 4 and 5, the housing 15, typically formed of aluminum, includes a pair of cylindrical parallel holes 70. Two or more cylindrical recirculating ball bearing steel sleeves 71 are fixed in each of the holes 70. Each of the sleeves 71 includes six oblong circuits 72 of recirculating balls 73. Balls 73A are load carrying balls in bearing contact between the sleeve 71 and the slide 16. Balls 73B are recirculating balls free to roll in clearance provided in the sleeves 71. The slide 16 which is carrying the load on the armrest 12 is rolled freely or fluidly along the load carrying balls 73A. The sleeves 71 include retainers which guide the balls 73 in the paths of the oblong circuits 72 to prevent the balls 73 from falling out such as when the slides 16 are removed from the sleeves 71 or such as when the sleeves 71 are removed from the housing 15.

As shown in FIG. 4, each of the sleeves 71 is fixed in its respective hole 70 via a locking washer 75 with an inner diameter 75 greater than the diameter of the rods 80 for avoiding friction between the rods 80 and washers 75. Each of the washers 76 includes a set of radial legs 77 for engaging the walls of the housing 15 which form the holes 70.

Figure 14:
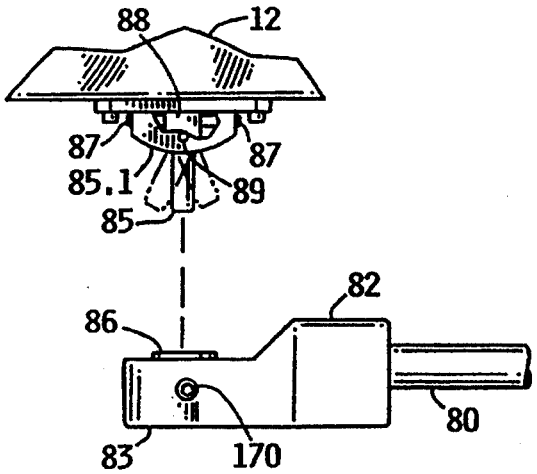
FIG. 14 shows means for tilting and locking the stem of the armrest of the arm support of FIGS. 1 and 2.

The slide 16 includes two steel linear rods 80 which actually engage the load-carrying balls 73A. The rods 80 may be stainless steel rods or be chrome-plated to prevent rust. The rods 80 are parallel to each other and spaced in such relation by a rear stop 81 and a front stop 82. The rear stop 81 is an aluminum plate fixed to and between the rear ends of the rods 80 and engages a resilient bumper 81.1 on the rear end 81.2 of the housing 15 to prevent a further sliding of the slide 16 in a forward direction. The front aluminum stop 82 is fixed to and between the front ends of the rods 80 and engages a resilient bumper 82.1 on the front end 82.2 of the housing 15 to prevent a further sliding of the slide 16 in a rearward direction. The front stop 82 includes an integral triangular platform 83 with a seat or aperture 84 for a stem 85 depending from a foundation 85.1 for the armrest 12. Seat 84 and stem 85 may be referred to as a joint. A flanged bushing 86 is disposed in the seat 84 to provide for a fluid pivoting of the stem 85 and armrest 12 relative to the seat 84 and slide 16. The bushing 86 is formed of a plastic with a low coefficient of friction such as TEFLON® or polytetrafluoroethylene or material. A tilt to the arm rest 12 may be provided by adjusting the angle of the stem 85 relative to the armrest 12. Such a tilt is effectuated by loosening and tightening a pair of opposing pin connectors 87, as shown in FIG. 14, against an inner end 88 of the stem 85. Stem 85 includes a pivot 89 connected to the armrest foundation 85.1.

The armrest 12 includes a rigid aluminum curved or bowed plate 90 to which a closed cell foam padding 91 is affixed. A removable, washable fabric covering 92 overlays the cushioned plate 90 and padding 91. The plate 90 may be formed of plastic.

In operation, to install the arm support 10, the U-shaped clamp 30 is clamped to the desired position on the table top 23 by tightening the knob 32. The desired height for the armrest 12 or slide 16 relative to the table surface 24 is determined by orienting the standard 14 at the proper height by tightening the handle 46. The stem 62 of the slide 16 is then inserted in its seat 61 of the standard 14. The proper tilt of the stem 85 of the armrest 12 is set by turning the pin connectors 87. Subsequently the stem 85 of the armrest 12 is seated in its seat 84 to complete setup of the arm support 10.

For keying or other similar operations, a forearm and/or a wrist is placed on the armrest 12. While the forearm or wrist is on the armrest 12, the armrest 12 is swingable for 360° relative to the slide 16 via the stem 85 and seat 84; the armrest 12 is slidable to and away from the housing 15 via the slide 16; and the armrest 12 is swingable for 360° about the standard 14 via the stem 62 and seat 61. During such movements, the armrest 12 fluidly follows the lead of the forearm via the TEFLON® or polytetrafluoroethylene material or bushing 86 between the stem 85 and seat 84, the recirculating balls 73 which engage the rods 80, and the TEFLON® or polytetrafluoroethylene material or bushing 63 between the stem 62 and seat 61.

Figure 6:
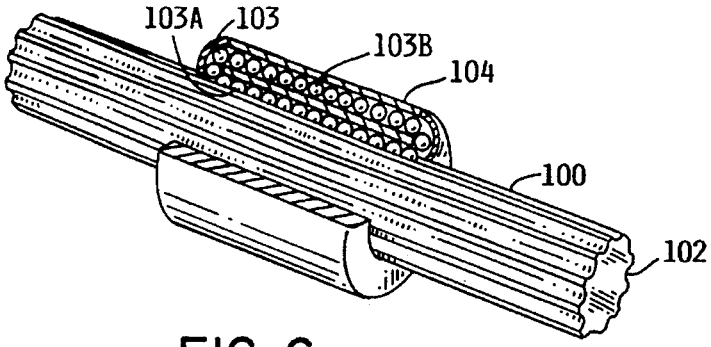
FIG. 6 is a perspective partial view of an alternate embodiment of the present arm support and shows a splined slide for engaging recirculating ball bearings to prevent rotation of the slide.
Figure 7:
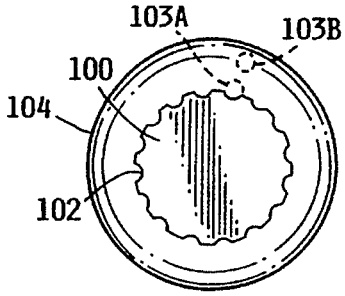
FIG. 7 is a section view of the alternate embodiment of FIG. 6.

As shown in FIGS. 6 and 7, in an alternate embodiment of the invention, an arm support may include only one rod or shaft slide 100. The rod or slide 100 includes a number of splines 102 or means for preventing rotation 102 of the slide 100. At least three of the splines 102 are engaged by recirculating balls 103 of a recirculating ball sleeve 104 to prevent rotation of the slide 100. Balls 103A are shown as engaging one of the splines 102; balls 103B are shown as recirculating in a circuit. In such an arrangement, although more than one slide 100 may be used for greater support, only one slide 100 is preferred to conserve space and weight. It should be noted that the provision of two rods 80 in the arm support 10 may also be referred to as a means for preventing rotation of the slide 16.

Figure 8:
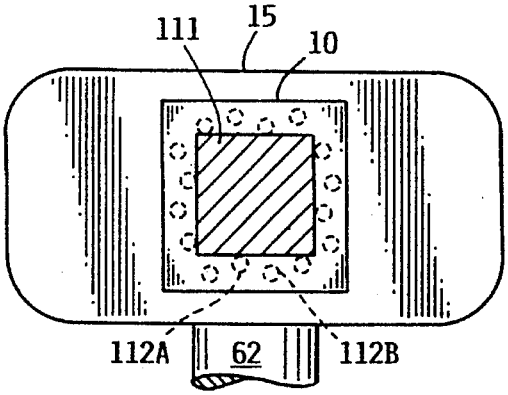
FIG. 8 is a section partial view of an alternate embodiment of the present arm support and shows a slide with a square cross section to prevent rotation of the slide.
Figure 9:
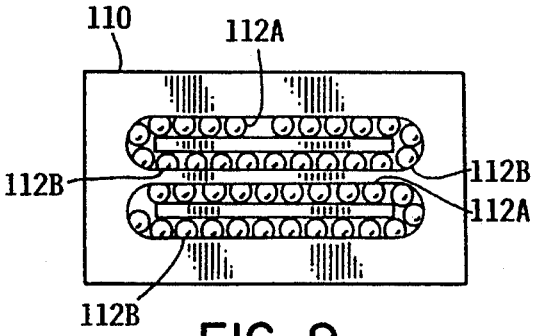
FIG. 9 is a section partial view of the alternate embodiment of FIG. 8 and illustrates recirculating ball bearing circuits.

As shown in FIGS. 8 and 9, in an alternate embodiment of the invention, the housing 15 includes a recirculating ball bearing sleeve 110 with a square cross section for engaging a rod or slide 111 with a square cross section. The recirculating ball bearing sleeve 110 includes recirculating balls 112 with balls 112A engaging the slide 111 and balls 112B being recirculated from engagement. Such a noncircular, squared shape of the sleeve 110 and slide 111 prevents rotation of the slide 111 and may be referred to as a means for preventing torque or rotation of the slide 111.

Figure 10:
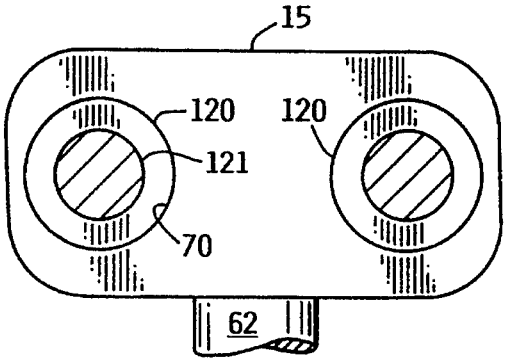
FIG. 10 is a section, partial view of an alternate embodiment of the present arm support and shows a slide engaging a ceramic pillow block or sleeve with a low coefficient of friction.

As shown in FIG. 10, in another alternate embodiment of the invention, the housing 15 includes a pair of cylindrical pillow blocks or sleeves 120 engaging the pair of rods 80 for forming a slide. The sleeves 120 are formed of a ceramic with a low coefficient of friction such as FRELON® and are fixed in the apertures 70 of the housing 15.

Figure 11:
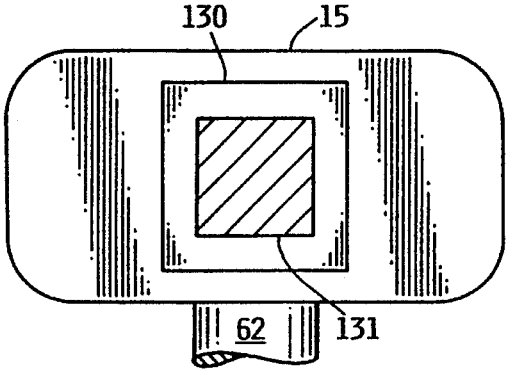
FIG. 11 is a section, partial view of an alternate embodiment of the present arm support and shows a slide with a square cross section engaging a ceramic pillow block or sleeve with a low coefficient of friction.

As shown in FIG. 11, in another alternate embodiment of the invention, the housing 15 includes a sleeve or pillow block 130 which is formed of a ceramic with a low coefficient of friction such as FRELON®. The sleeve or means for preventing rotation 130 is square in cross section for engaging a rod or slide 131 square in cross section to prevent rotation of the rod 131. As with sleeve 120, sleeve 130 is fixed in the housing 15.

Figure 12:
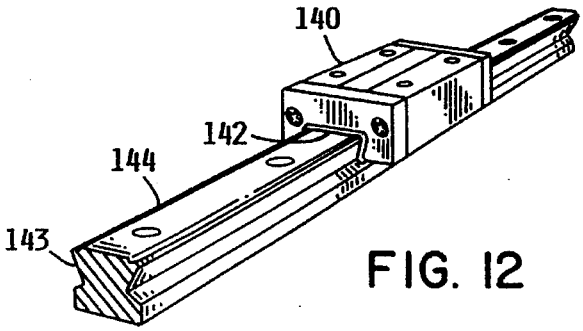
FIG. 12 is a section, partial view of an alternate embodiment of the present arm support and shows a slide engaging recirculating ball bearings in a track formed in a housing.

As shown in FIG. 12, in another alternate embodiment of the invention, a housing such as the housing 15 may include a block 140. The block 140 includes a dovetailed track 142 with recirculating ball bearings. A dovetailed portion 143 of a slide or rail 144 engages the recirculating ball bearings of the dovetailed track 142 for mounting the armrest 12.

Figure 13:
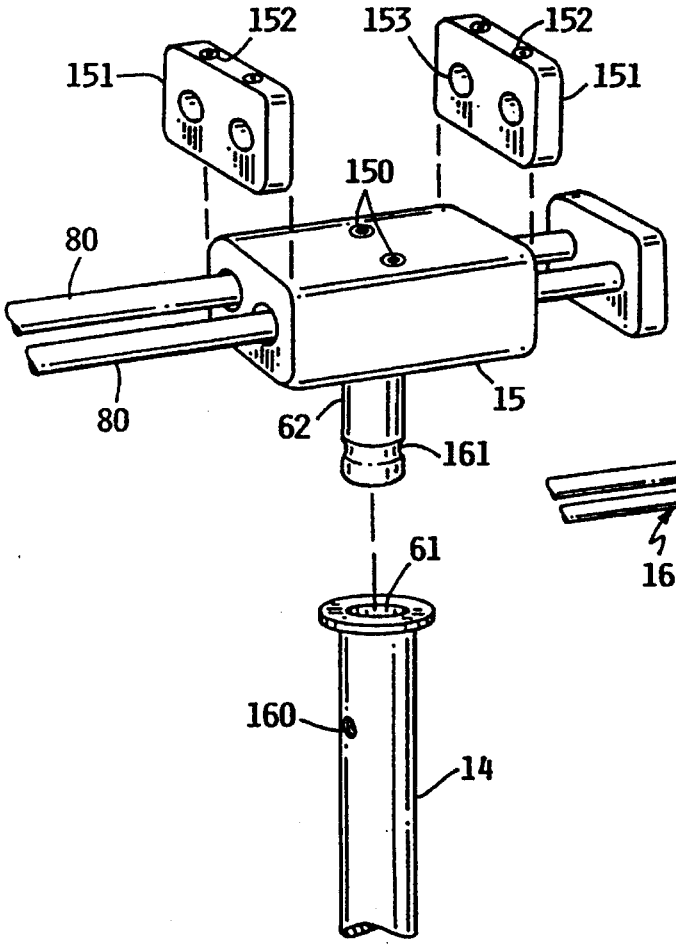
FIG. 13 is an exploded view showing slide restrictions for the arm support of FIGS. 1 and 2.

As shown in FIG. 13, in an alternate embodiment of the invention, the housing 15 may have various means for at least partially limiting or restricting or locking sliding of the slide 16. Such means includes a pair of threaded pin connectors 150 in the base 15 for being tightened against the rods 80. Such means may also include removable end stops 151 with pin connectors 152 for engaging the rods 80. For locking the slide 16 at a particular location for locating the armrest 12 at a particular location, both of the end stops 151 may be utilized. For shortening or lengthening the effective sliding of the slide 16, one of the end stops 151 is utilized. One of the end stops 151 is placed on the slide 16 by removing end stop 81 or 82 which is fixed to the slide 16 via set screws or pin connectors, and then sliding the end stop 151 on to the slide 16 via apertures 153. The end stop 151 is then fixed to the slide 16 via set screws 152. As the slide 16 is used to shorten or lengthen the stroke of the slide 16, it may be referred to as means for controlling or adjusting the length of the stroke of the slide.

Also as shown in FIG. 13, the standard 14 may include a means for limiting or restricting or locking pivoting of the stem 62 relative to the standard 14. Such means may include a pin connector 160 for engaging an annular groove 161 formed on the stem 62. Such an engagement also prevents inadvertent removal of the stem 63 from the seat 61.

As shown in FIG. 14, in an alternate embodiment of the invention, the slide 16 may include means for limiting or restricting or locking pivoting of the armrest 12 relative to the slide 16. Such means may include a pin connector 170 in the triangular piece 83 of the slide 16 for engaging the stem 85.

Figure 15:
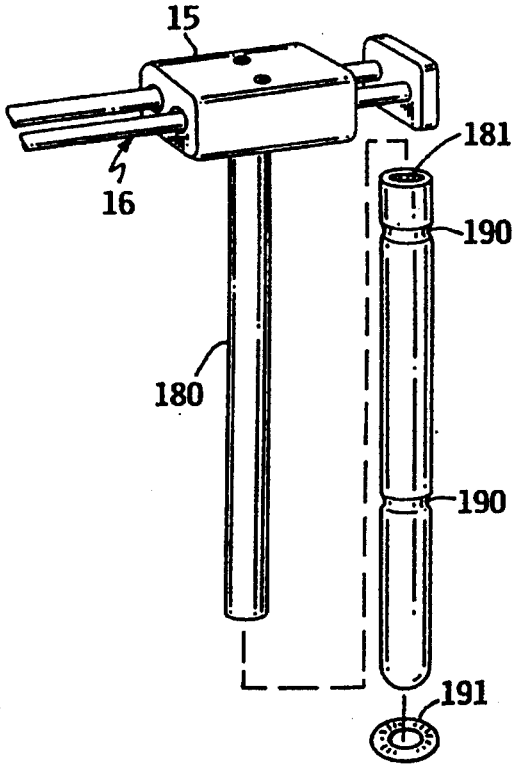
FIG. 15 shows an alternate standard for the arm support of FIGS. 1 and 2.

As shown in FIG. 15, in an alternate embodiment of the invention, an elongate stem 180 replaces the shorter stem 62. The seat 181 is formed to a greater depth in the standard 14 to accommodate the longer stem 180. The longer stem 180 and seat 101 are precision formed and may include a lubrication such as a TEFLON® or polytetrafluoroethylene material or grease to provide for a fluid pivoting between the stem 180 and seat 181. The lubrication or grease may include molybdenum disulfide. An advantage of the longer stem 180 is that it may minimize a tilting or deflection of the housing 15 and slide 16 such that the triangular end piece 83 is less likely to scrape against the surface 24 of the table 23 when the armrest 12 is supporting a relatively great amount of weight. In other words, with a longer stem 180, the slide 16 is more likely to remain parallel m the table surface 24. Accordingly, the housing 15 and slide 16 may be mounted closer m the table surface 24. It should further be noted that the stems 62, 180 may be replaced by a needle bearing.

As also shown in FIG. 15, in alternate embodiment of the invention, the standard 14 may include annular seats 190 for seating an O-ring or safety washer or stop 191 for preventing the standard 14 from falling to the floor when the handle 46 is loosened to widen the diameter of the aperture 51 to release the standard 14. If the aperture 51 is so widened and the standard 14 slips downwardly, the safety washer 191 prevents the standard 14 from falling out of the block 40 by engaging the top of the block 40.

As shown in FIG. 1 and FIGS. 16–18, the chair 20 includes a seat or seat pan 200, a back support 201, and a set of legs 202. The seat 200 is fixed to a spindle 203 which pivots in a bushing 204, which in turn is fixed to the legs 202. In an alternate embodiment of the invention, a pair of elongate supports 205 are fixed to the spindle 203 for pivoting with the seat 200 and back support 201. Each of the elongate supports 205 includes a bar formed in generally the shape of an "L" with a proximal end 206 and a bent distal end 207. Apertures 208 are formed in each of the proximal ends 206 of each of the elongate supports 205 for receiving the threaded ends of a pair of U-bolts 209 for fixing the elongate supports 205 to each other and to the spindle 203 via locking nuts 210. The effective length of each of the elongate supports 205 relative m a periphery 211 of the chair seat 200 is adjustable via the plurality of apertures 208. The block or base portion 40 is connectable to the distal end 207 which includes apertures 213, 214 identical in orientation to respective apertures 42, 44 of U-clamp 30 for engaging pins 41 and 43. As an alternative to the plurality of apertures 208, the elongate supports 205 may include slots 215 for engaging U-bolts 209. Accordingly, the arm support 10 rotates with the seat pan 200 via the elongate support 205, which is fixed to the spindle 203 with no drilling or damage thereto.

Figure 17:
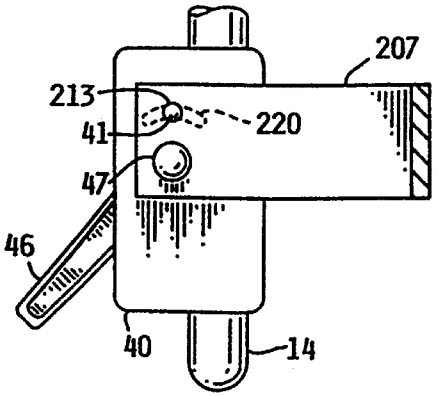
FIG. 17 is a section view at lines 17—17 of FIG. 16.

In an alternate embodiment of the invention, as shown in FIG. 17, a groove 220 may be formed in the face of distal end 207 which confronts the base portion 40. In this embodiment the dowel pin 43 is shortened to a nub and the aperture 41 is eliminated to be replaced by the groove 220. The groove 220 is curved radially about aperture 214 and includes an undulating floor to define certain seats for the nub. Accordingly, the standard 14, the slide 16 and the armrest 12 are tiltable relative to the base portion 40 by being pivotal about pin connector 43. Such a groove 220 may also be formed in the surface of the U-clamp confronting the base portion 40.

Figure 19:
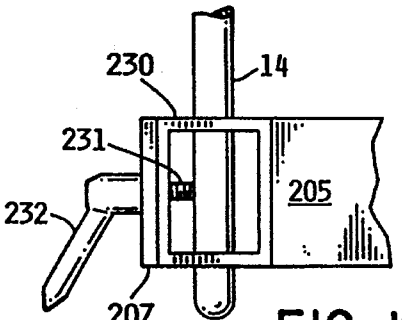
FIG. 19 is a front elevation view of an alternate embodiment of a base fixed to the elongate support of FIG. 16.

It should be further noted, as shown in FIG. 19, that instead of the base 40, the elongate support 205 may include a tubular member 230 affixed to the inner side of end 207. The tubular member 230 engages apertures formed in tubular member 230 and is engaged by a male pin connector 231 of a handle 232. The pin connector 231 is threadably engaged with the end 207 and one side of the tubular member 230. Accordingly, the standard 14 is adjustable in height in the tubular member 230.

Figure 16:
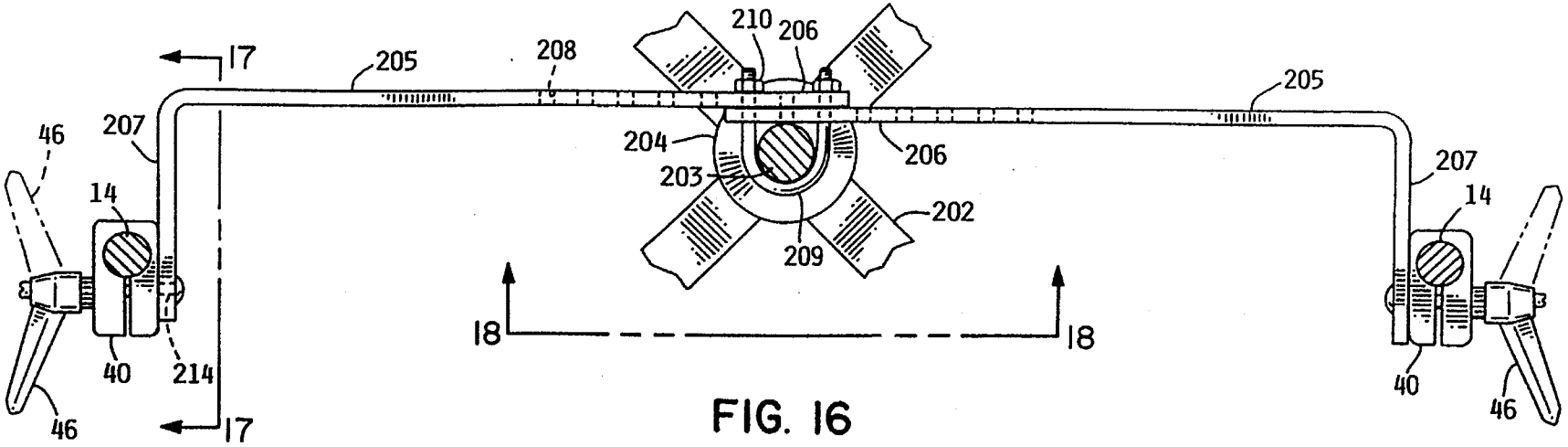
FIG. 16 shows a section view at lines 16—16 of FIG. 1 to illustrate an elongate support for fixing the present arm support to the spindle of a chair.
Figure 18:
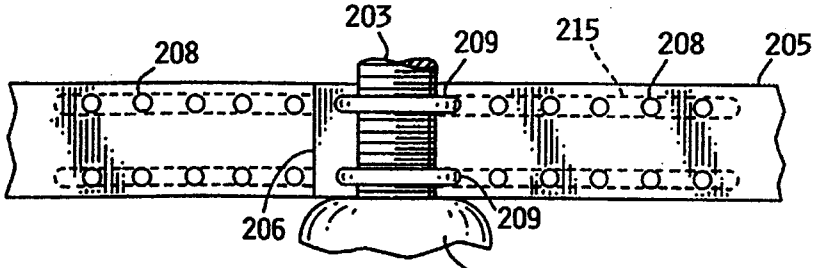
FIG. 18 is a section view at lines 18—18 of FIG. 16.

It should be noted that the handle 46 may be of a spring-loaded type such that the handle 46 may be oriented in a different position without a further tightening or disengagement of the standard 14 from the block 40. FIG. 16 shows such relative orientation of the handle 96 to, for example, move the handle 46 to an out-of-the way position to prevent inadvertent bumping of the handle 46.

In an alternative embodiment, a pillow block 250 preferably includes an interior and exterior. The pillow block 250 may be formed of one piece, or may be split at the preference of an individual in two pieces. If a split pillow block 250 is selected, as see in FIG. 23C, preferably at least two tightening means 252 having springs 254 are provided. The tightening means 252 preferably engage both portions of the split pillow block 250. The tightening means 252 may be manipulated for adjustment of the level of engagement between the rods 80, or linear slides 16, and the roller bearing means 256. If more friction is desired between the rods 80, or linear slides 16, and the roller bearing means 256, then the tightening means 252 may be rotated in a clockwise direction, for reduction of the fluid relationship between the rods 80, or linear slides 16, and the pillow block 250. If less friction is desired, the tightening means 252 may be incrementally released for facilitating the fluid relationship between the rods 80, or linear slides 16, and the roller bearing means 256. The clockwise rotation of the tightening means 252 squeezes the portions of the pillow block 250 together, which in turn squeezes the rods 80 against the roller bearing means 256. The fluid motion of the arm support 10 within the pillow bock 250 is thereby reduced. A spring 254 preferably encircles each tightening means 252. The spring 254 provides for the incremental adjustment of the engagement between the portions of the pillow block 250 and the rods 80 or linear slides 16. It should be noted that the tightening means 252 may be omitted at the preference of an individual.

The pillow block 250 preferably includes a front face 258 and a rear face 260. In the preferred embodiment, at least two apertures traverse the front face 258. The apertures through the front face 258 are preferably adapted for receiving engagement of the rods 80 or linear slides 16. In addition, the rear face 260 preferably includes at least two apertures which are longitudinally aligned to the apertures through the front face 258. The apertures through the rear face 260 are preferably adapted for receiving engagement of the rods 80 or linear slides 16. It should be noted that the apertures through the front face 258 and rear face 260 are preferably aligned so that the rods 80, or linear slides 16, are substantially parallel within the pillow block 250.

Figure 20:
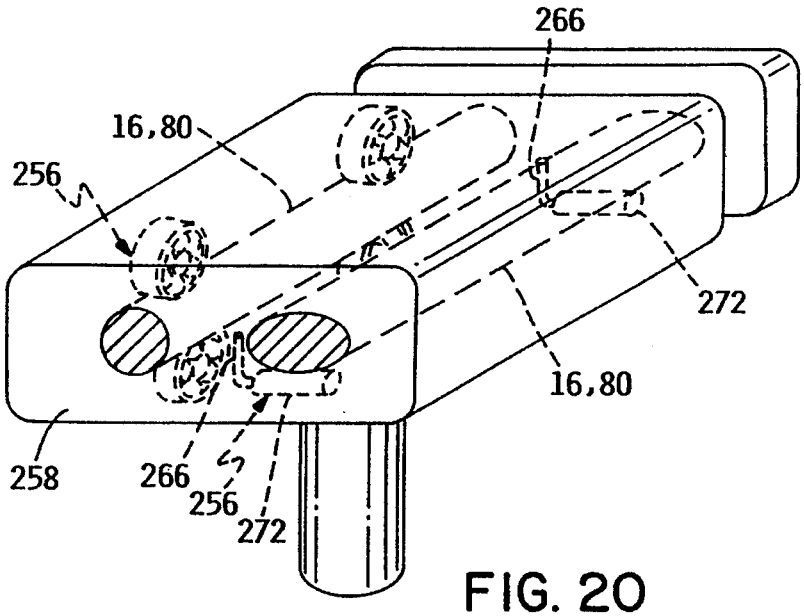
FIG. 20 is a partial phantom line perspective view of the pillow block including alternative embodiments of the roller bearing means.
Figure 24:
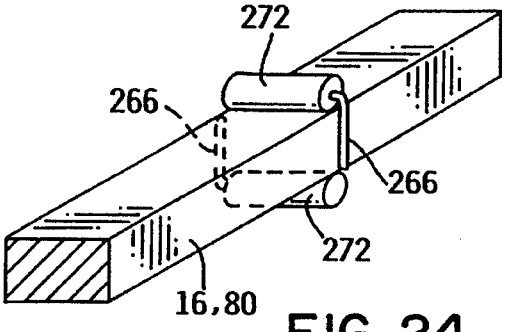
FIG. 24 is a partial perspective view of a square linear slide and alternative roller bearing means.

As seen in FIGS. 20 and 24, the rods 80, or linear slides 16, may have any cross-sectional shape as preferred by an individual including, but not limited to, circular, oval and/or square. It should be noted that the performance of the arm support device 10 is not affected by the cross sectional shape selected for the rods 80 or linear slides 16. Alternative roller bearing means 256 may be selected for engagement to either circular, oval, or square cross-sectional shaped rods 80, or linear slides 16, at the preference of an individual provided that the essential functions, features, and attributes described herein are not sacrificed.

Figure 27:
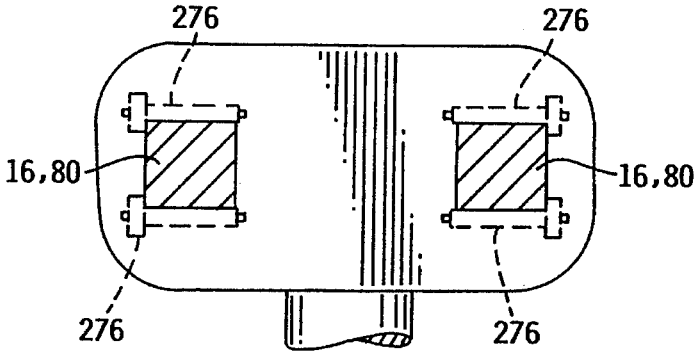
FIG. 27 is a cross sectional end view of the invention showing a circular linear slide and alternative roller bearing means.

The roller bearing means 256 preferably engage the rods 80 within the interior of the pillow block 250. In the simplest embodiment, the roller bearing means 256 include a solid shaft 262 which is surrounded by a hollow tubular collar 264. (FIGS. 20, 22, 234 and 25) The hollow tubular collar 264 is the portion of the roller bearing means 256 which engages the rods 80, or linear slides 16, within the interior of the pillow block 250. In this embodiment, the solid shaft 262 is preferably rigidly affixed to, and extends inward from, the interior walls of the pillow block 250, for engagement below and above each of the rods 80 or linear slides 16. (FIGS. 24, 20, and 27).

A guide ledge 266 is preferably affixed to, and extends perpendicularly from, each of the solid shafts 262, and is positioned proximal to a lateral side of a rod 80 or linear slide 16. The guide ledges 266 function to retain the rods 80 in a position for engagement to the roller bearing means 256 during use of the arm support device 10. The guide ledges 266 function to prevent the slippage or lateral movement of the rods 80, or linear slides 16, within the pillow block 250, such that engagement to the roller bearing means 256 is terminated.

The engagement of the rods 80, or linear slides 16, to the hollow tubular collar 264, functions as a means for providing fluid motion of the rods 80 within the pillow block 250. Engagement between the hollow tubular collar 264 and the solid shaft 262 is preferably of reduced friction. The friction between the hollow tubular collar 264 and the solid shaft 262 may be minimized by the selection of friction reducing materials such as TEFLON® or polytetrafluoroethylene material or polyethylene materials. In this embodiment, the material selected for the solid shaft 262, and hollow tubular collar 264, facilitates the rotation of the hollow tubular collar 264 in the either a clockwise or counterclockwise direction about the solid shaft 262. In this embodiment, a square or oval shaped rod 80, or linear slide 16, is preferably used in the arm support device 10. The guide ledges 266 preferably extend vertically upwards or downwards from the solid shaft 262 for engagement to the lateral side of a rod 80 or linear slide 16.

Figure 23A:
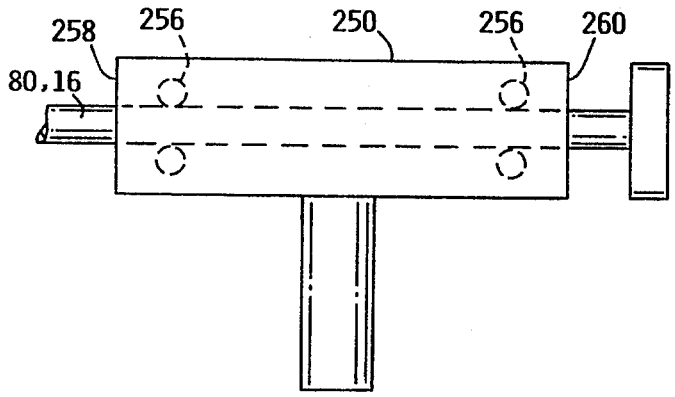
FIG. 23A is a detail side view, partial phantom line view of the pillow block showing alternative roller bearing means.
Figure 23B:
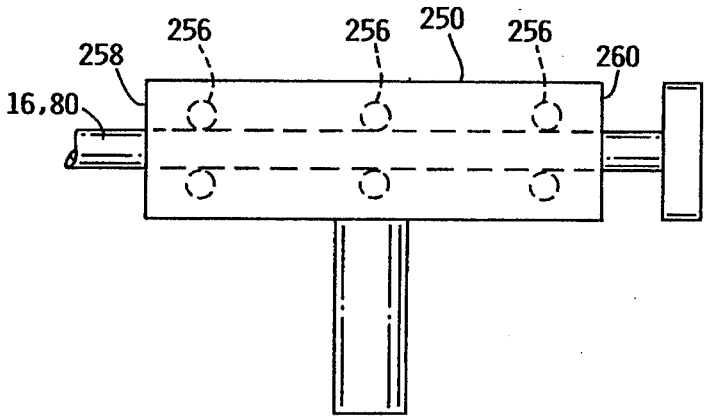
FIG. 23B is a detail side view, partial phantom line view of the pillow block showing alternative roller bearing means.
Figure 23C:
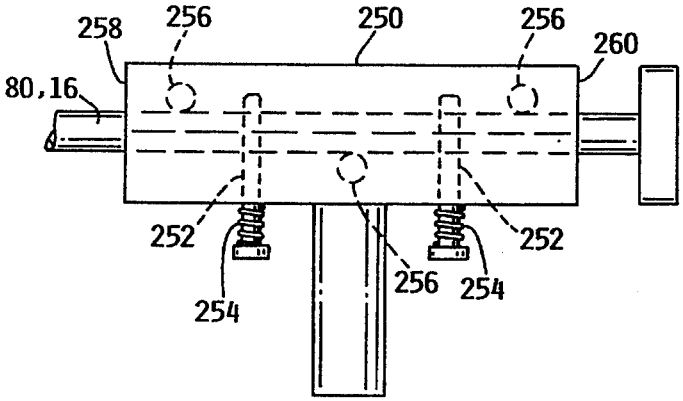
FIG. 23C is a detail side view, partial phantom line view of the pillow block showing alternative roller bearing means.
Figure 25:
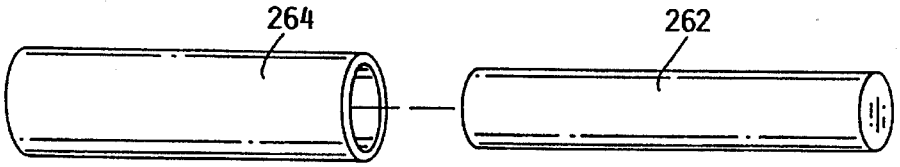
FIG. 25 is a partial exploded view of an alternative roller bearing means of FIGS. 22 and 24.
Figure 26:
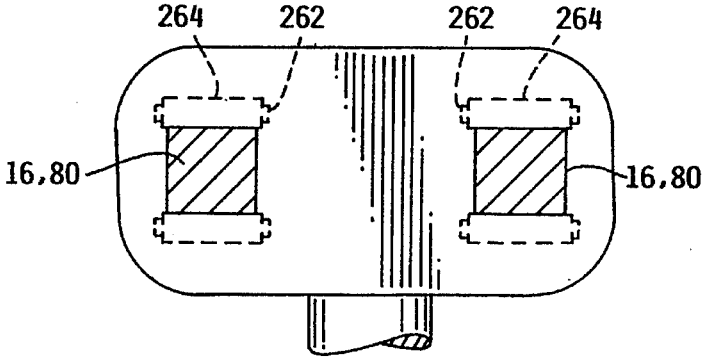
FIG. 26 is an end view, partial phantom line view of a square slide as seen in FIG. 24.

A plurality of roller bearing means 256 are positioned above and below each of the rods 80, within the interior of the pillow block 250. As seen in FIGS. 23A, 23B, and 23C, the arrangement of the roller bearing means 256 may vary considerably at the discretion of an individual. As depicted in FIG. 23A, a roller bearing means 256 is positioned above and below each of the rods 80 proximal to the front face 258. Additional roller bearing means 256 are positioned above and below each of the rods 80 proximal to the rear face 260. As depicted in FIG. 23B, the plurality of roller bearing means 256 are equally spaced above and below each of the rods 80 within the interior of the pillow block 250. As depicted in FIG. 23C, a roller bearing means 256 is positioned above each of the rods 80 proximal to the front face 258 and rear face 260, and a single roller bearing means 256 is positioned centrally below each of the rods 80 within the interior of the pillow block 250. It should be noted that any desired combination of roller bearing means 256 may be used above or below the rods 80, or linear slides 16, at the preference of an individual provided that a sufficient number of roller bearing means 256 are used to facilitate and support a fluid range of motion the arm support device 10.

Figure 21:
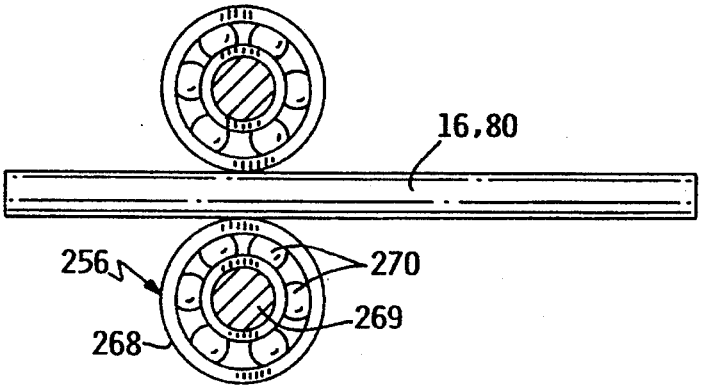
FIG. 21 is a detail end view of a container of the roller bearing means.
Figure 22:
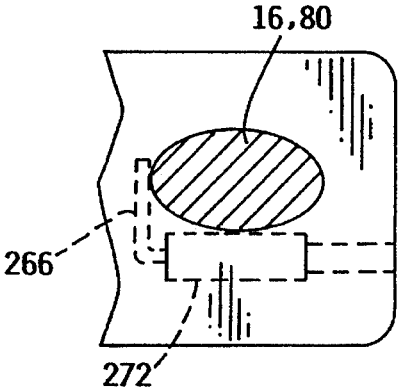
FIG. 22 is a cross sectional end view taken along the line 22—22 of FIG. 20 showing an oval linear slide and alternative roller bearing means.

In the preferred embodiment as depicted in FIGS. 20 and 21, the roller bearing means 256 include a container 268 confining a plurality of ball bearings 270. As seen in FIG. 20, the container 268 preferably encircles a rod 80 within the interior of the pillow block 250. It should be noted that a container 268, confining a plurality of ball bearings 270, is preferably located proximal to the front face 258, and to the rear face 260, within the interior of the pillow block 250. Each container 268 preferably encircles one of the rods 80 or linear slides 16. Each container 268 preferably has an internal diameter dimension of sufficient size to confine, and position the plurality of ball bearings 270 into an encircling arrangement around a rod 80. In this embodiment, any cross sectional shape may be selected for the rods 80 at the preference of an individual including, but not limited to, square, circular, or oval. It should be noted that a container 268 may be of any preferred shape including, but not limited to, circular, square, and/or oval at the discretion of an individual for use with a particular shape of rod 80. The containers 268, and ball bearings 270, preferably provide for the fluid forward or rearward movement of the rods 80, within the pillow block 250, during use of the arm support device 10. It should be noted that each of the containers 268 of ball bearings 270 is preferably affixed to the interior of the pillow block 250. It should also be noted that the use of guide ledges 266 is not necessary due to the encircling of the rods 80 by the roller bearing means 256.

Figure 28:
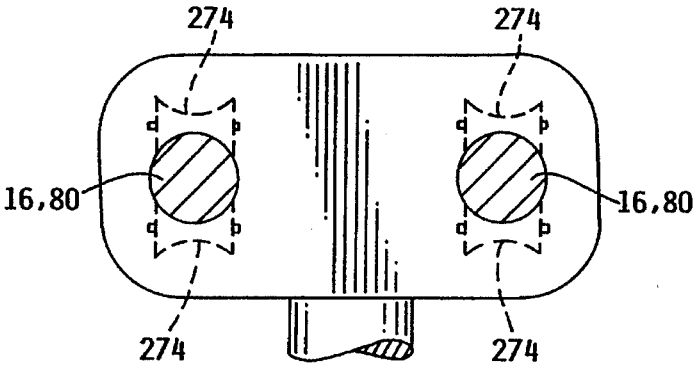
FIG. 28 is a cross sectional end view of the invention showing a circular linear slide and alternative roller bearing means.
Figure 29:
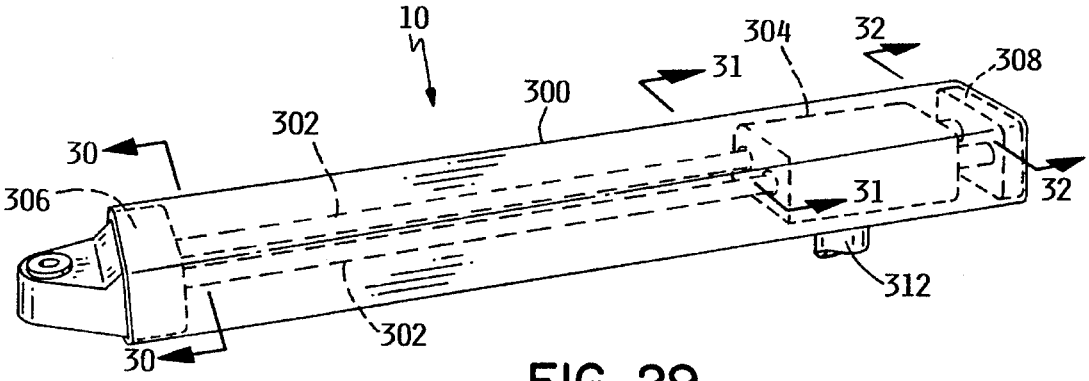
FIG. 29 is an environmental view of a shroud engaged to the arm support of FIG. 1.
Figure 30:
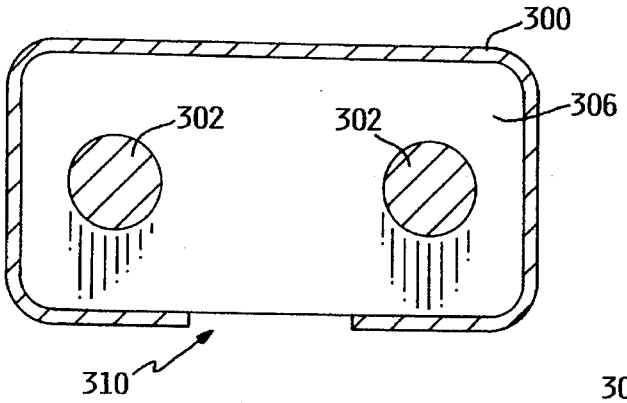
FIG. 30 is a cross-sectional side view taken along line 30—30 of FIG. 29.
Figure 32:
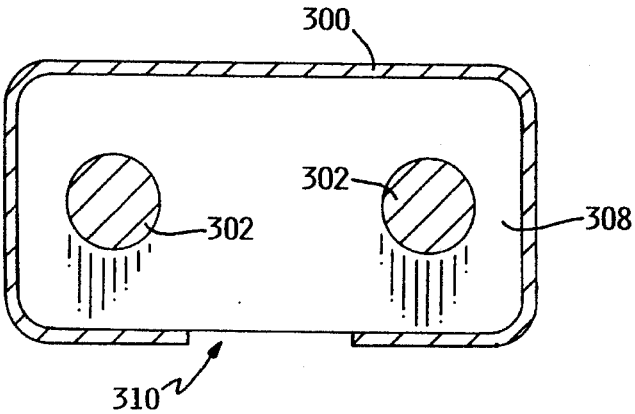
FIG. 32 is a cross-sectional side view taken along line 32—32 of FIG. 29.

In an alternative embodiment, as depicted in FIG. 28, the roller bearing means 256 includes a plurality of rollers 272, where each roller has internal bearings and an arcuate receiving surface 274. The arcuate receiving surface 274 is adapted for flush and continuous engagement to the rods 80 or linear slides 16. In this embodiment, a roller 272 is preferably positioned above and below each of the rods 80, such that the arcuate receiving surfaces 274 interface to flushly confine the rods 80 within the interior of the pillow block 250. In this embodiment, the necessity of the use of guide ledges 266 is eliminated due to the substantially encircling relationship of the arcuate receiving surfaces 274 around each of the rods 80. The rollers 272 thereby function to flushly engage and confine the motion of the rods 80 to a forward or rearward direction within the pillow block 250. The rollers 272 are preferably aligned within, and are affixed to, the interior of the pillow block 250, for positioning of the rods 80 through the apertures traversing the front face 258 and rear face 260.

An alternative roller bearing means 256 is depicted in FIG. 27 showing the use of flanged rollers 276 having internal bearings. The flanged rollers 276 incorporate the features of the rollers 272, and the guide ledges 266, into a single mechanism. The flanged rollers 276 are preferably positioned within, and are affixed to the interior of, the pillow block 250 such that the flanged portion of each roller 276 is positioned proximal to a side wall. The flanged rollers 276 are preferably used in conjunction with a rod 80 having a square cross-sectional shape as seen in FIG. 27. In this embodiment, a plurality of flanged rollers 276 are positioned above and below each of the rods 80, supporting the fluid motion for the arm support device 10. The number of flange rollers 276 used in the arm support device 10 may vary considerably at the preference of an individual. In the preferred embodiment, four and eight flanged rollers 276 are used to support each rod 80. It should be noted that a sufficient number of flanged rollers 276 are required above and below each of the rods 80 to facilitate the sliding fluid engagement within the pillow block 250 during use of the arm support device 10. In this embodiment, the flanged portion of the rollers 276 are preferably positioned to the exterior of the rods 80. It should be noted that an individual may position the flanged portion of a roller 276 on any side of a rod at his/her discretion provided that the non-flanged surface of each roller 276 supports a rod 80 during use of the arm support device 10. An individual may alternate the positioning of the flanged portions of the rollers 276 to the interior or the exterior of the rods 80 at his or her discretion. The flanged rollers 276 function to confine the position of the rods 80 within the pillow block 250 for elimination of the guide ledges 266. The flanged rollers 276 preferably function to confine the rods 80 for "straight-line" forward or rearward fluid motion within the pillow block 250.

In an alternative embodiment of the invention as depicted in FIGS. 29–32, a shroud 300 is provided for covering of the linear slide 302, pillow block 304, front stop 306, and rear stop 308. The shroud 300 is generally elongate and includes a slot 310. The slot 310 is disposed adjacent to a stem 312 which is adapted to be engaged to a standard as previously described. The slot 310 is adapted for permitting the passing engagement of the stem 312 during movement of the linear slide 302 with respect to the pillow block 304.

Figure 31:
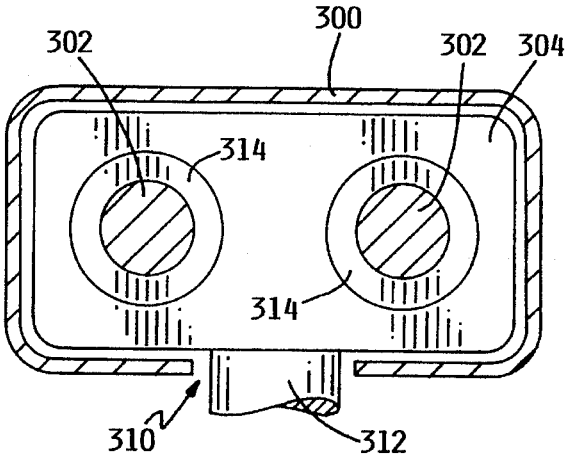
FIG. 31 is a cross-sectional side view taken along line 31—31 of FIG. 29.
Figure 31A:
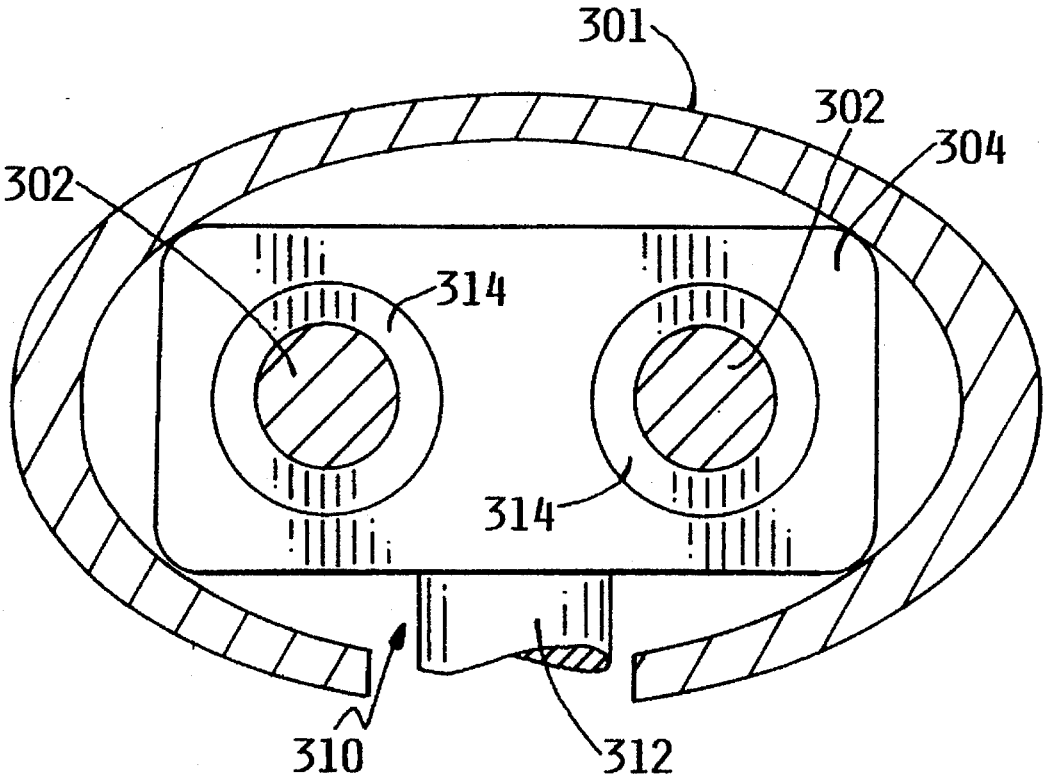
FIG. 31A is an alternative cross-sectional side view taken along line 31—31 of FIG. 29.
Figure 33:
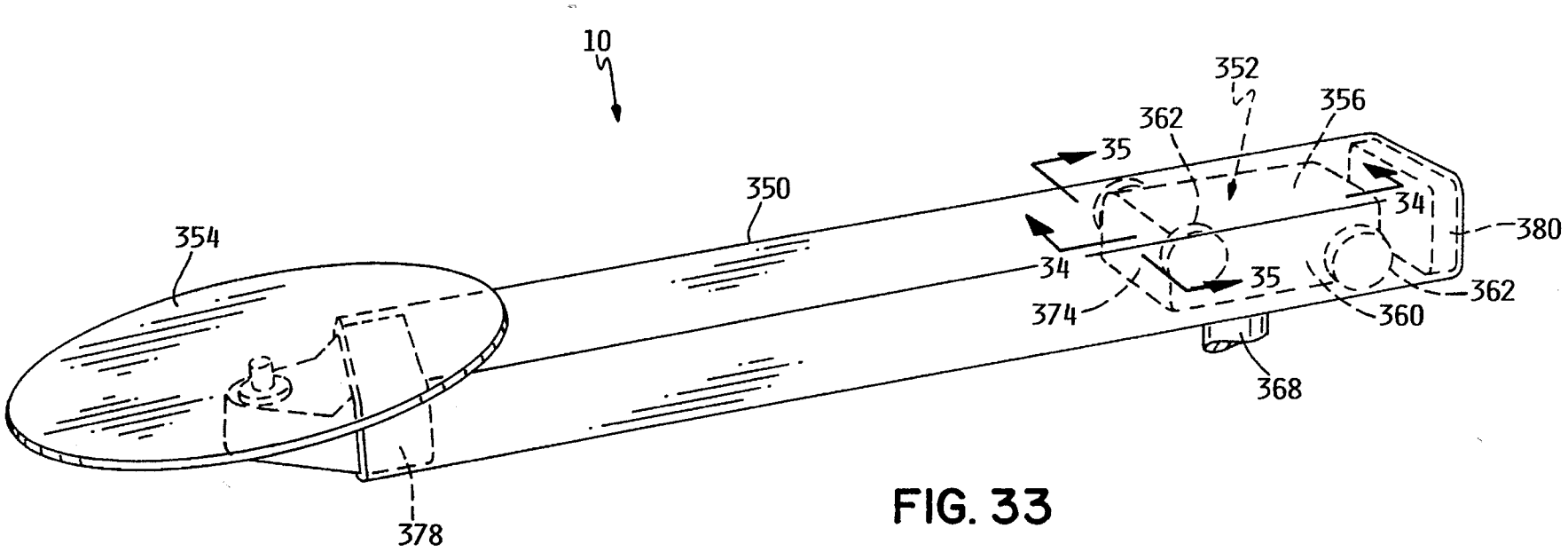
FIG. 33 is an environmental, partial phantom line view of an alternative embodiment of the invention.

The shroud 300 includes a substantially oval cross-sectional shape 301 (FIG. 31A). The cross-sectional shape for the shroud 300 may be varied considerably at the discretion of an individual. The shroud 300 preferably has a length dimension sufficient to engage the front stop 306, and rear stop 308 of the arm support 10. The shroud 300 may also be formed of extruded aluminum material. The material selected for the shroud 300 may be varied considerably at the discretion of an individual provided that the essential functions, features, and attributes described herein are not sacrificed. It should be noted that the shroud 300 may be formed of any material having sufficient strength to not fracture, bend, or fail during use of the arm support 10 by an individual.

The shroud 300 may be attached to the front stop 306 and to the rear stop 308 by machine pressing. The shroud 300 may alternatively be attached by any affixation means including but not limited to the use of screws, adhesives, welding, or bolts and nuts. The shroud 300 preferably encircles, but is not engaged to, the pillow block 304. The shroud 300 is thereby permitted to freely slide with respect to the position of the pillow block 304 in any direction as desired by an individual. (FIG. 31) It should be noted that the shroud 300 does not interfere with the sliding engagement between the linear slides 302 and the pillow block 304.

A purpose and function of the shroud 300 is to reduce the exposure and introduction of dust and dirt into the roller bearing means/ball bearing arrangements 314, enclosed with in the pillow block 304 as engaged to the linear slides 302. The reduction of contaminants into the pillow block 304 and roller bearing means/ball bearing arrangements 314 significantly improves the operation and useful life of the arm support 10. It should also be noted that the necessity for maintenance of the arm support 10 is thereby significantly reduced. An additional purpose of the shroud 300 is to minimize the risk of an individual's clothes and/or arm from being pinched between the linear slide 302 and the pillow block 304 during use of the arm support device 10.

In an alternative embodiment of the invention as depicted in FIGS. 33–39, a shroud 350 replaces the linear slides as previously described. In this embodiment a pillow block 352 engages the shroud 350 for the provision of the slidable motion of the arm rest 354 of the arm support 10.

In this embodiment, the pillow block 352 includes a first upper surface 356, a first lower surface 358, and a pair of opposite surfaces 360 which extend vertically between the first upper surface 356 and the first lower surface 358. In this embodiment, the roller bearing means 362 are engaged to the pair of opposite surfaces 360 via supports 364 and to the shroud 350. The roller bearing means 362 may be affixed to the pillow block 352 by any preferred means as selected by an individual, examples of which have been previously described. In this embodiment, the roller bearing means 362 is referenced to in general terms and may be comprised of: freely rotatable disks affixed to a pillow block 352 by an axle formed of a screw or pin where the roller disks either include or do not include bearings; a recirculating ball bearing arrangement; a linear bearing arrangement; or a roller bearing arrangement as earlier described. It should be noted that any of the above-described freely rotatable disks, recirculating ball bearing arrangements, linear bearing arrangements, or roller bearing arrangements may be freely substituted to function as the roller bearing means 362 at the discretion of an individual.

The pillow block 352 includes an aperture 366. The aperture 366 is adapted for receiving engagement of a set screw which affixes the pillow block 352 to the stem 368. (FIGS. 34–39) The engagement between the set screw, aperture 366, stem 368, and pillow block 352 prevents rotation between the stem 368 and pillow block 352. It should be noted that swingable rotation of the pillow block 352 is provided by the engagement of the stem 368 to the standard as earlier described. The other features and functions of the roller bearing means 362 and pillow block 352, including but not limited to the engagement to objects, vertical adjustment, and motion, are identical to the features and functions as earlier described.

A plurality of roller bearing means 362, including the alternative embodiments as earlier described are affixed to the pillow block 352. The roller bearing means 362 may be a freely rotatable disk 370 confining a plurality of ball bearings 372. As may be seen in FIGS. 34–39, a plurality of disks 370 may be positioned proximate to both the first upper surface 356 and first lower surface 358 of the pillow block 352. It should be noted that at least two disks 370 are engaged to the pillow block 352 proximate to the front face 374 and to the rear face 376. Each disk 370 preferably engages the shroud 350. Each disk 370 preferably has an internal diameter dimension of sufficient size to encircle a support 364 having sufficient strength to affix the roller bearing means 362 to the pillow block 352. Each support 364 may be affixed to, and extend perpendicularly outward from, one of the pair of opposite surfaces 360 of the pillow block 352. The fluid rotation of each disk 370 about the supports 364 provides for the fluid motion of the shroud 350 with respect to the pillow block 352. It should be noted that the cross-sectional shape selected for the supports 364 may include, but are not limited to, square, circular, or oval. It should also be noted that the disks 370 preferably have a circular shape. The disks 370, and ball bearings 372 preferably provide for the fluid forward or rearward movement of the shroud 350 as engaged to the pillow block 352 during use of the arm support device 10.

In an alternative embodiment, the roller bearing means 362 may additionally include a plurality of rollers where each roller has internal bearings and a shroud engaging surface. The shroud engaging surface is preferably adapted for flush and continuous engagement to the interior of the shroud 350. In this embodiment, a pair of rollers are preferably positioned proximate to each of the first upper surface 356 and first lower surface 358. In an alternative embodiment, the roller bearing means 362 may additionally include the use of flanged rollers having internal bearings.

Figure 34:
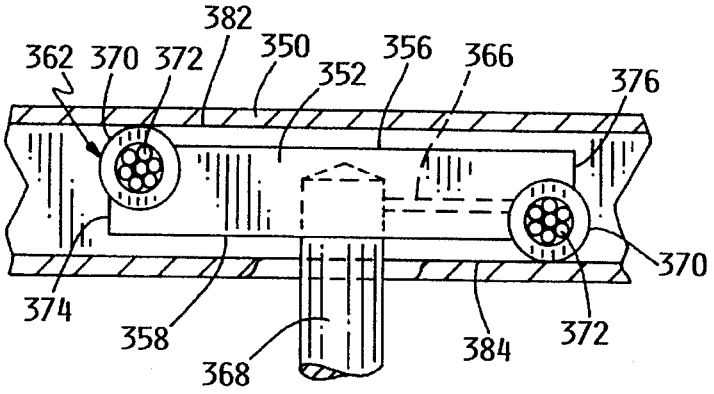
FIG. 34 is a partial cross-sectional side view of an alternate embodiment of the shroud and pillow block taken along line 34—34 of FIG. 33.
Figure 35:
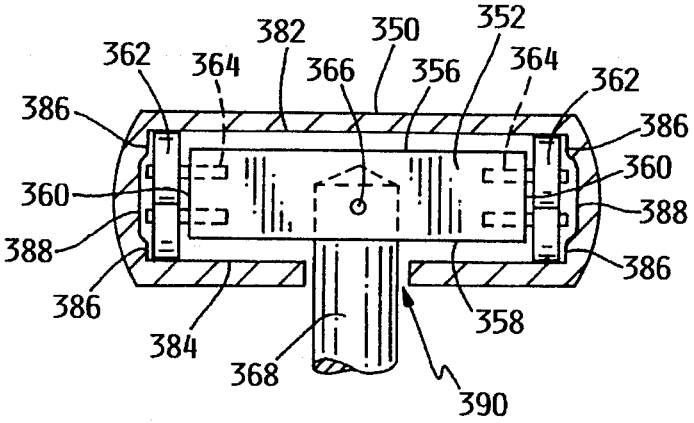
FIG. 35 is a cross-sectional side view of the invention taken along the line 35—35 of FIG. 33.
Figure 36:
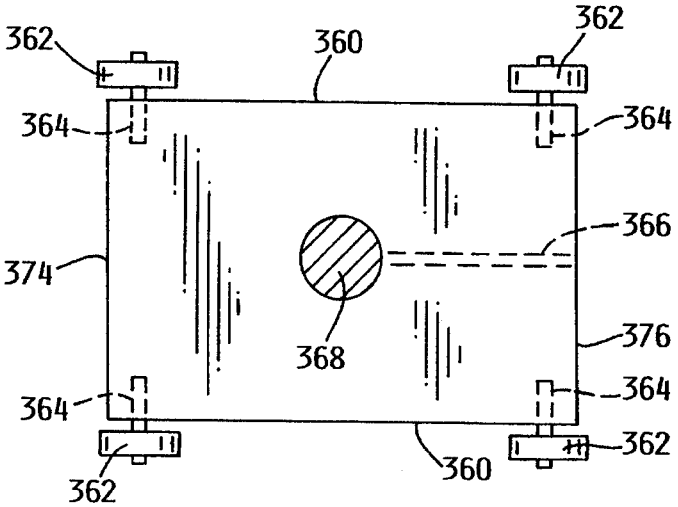
FIG. 36 is a partial top view of an alternate pillow block as depicted in FIGS. 33 and 34.
Figure 37:
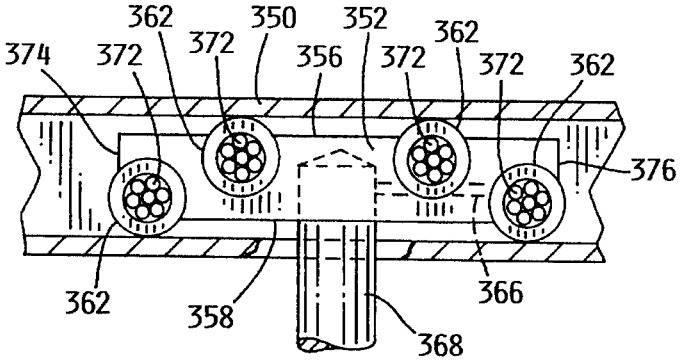
FIG. 37 is an alternate partial cross-sectional side view taken along line 34—34 of FIG. 33.
Figure 38:
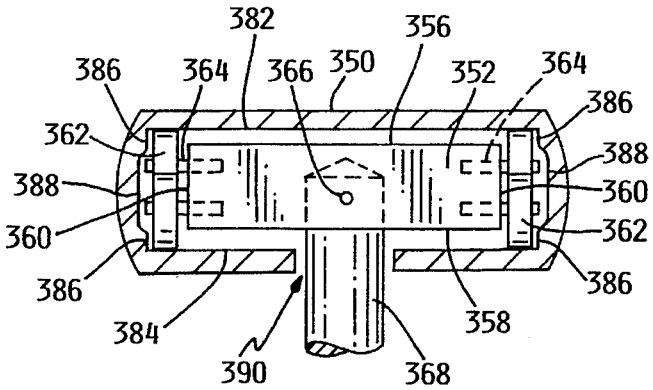
FIG. 38 is an alternate partial cross-sectional end view taken along line 35—35 of FIG. 33.
Figure 39:
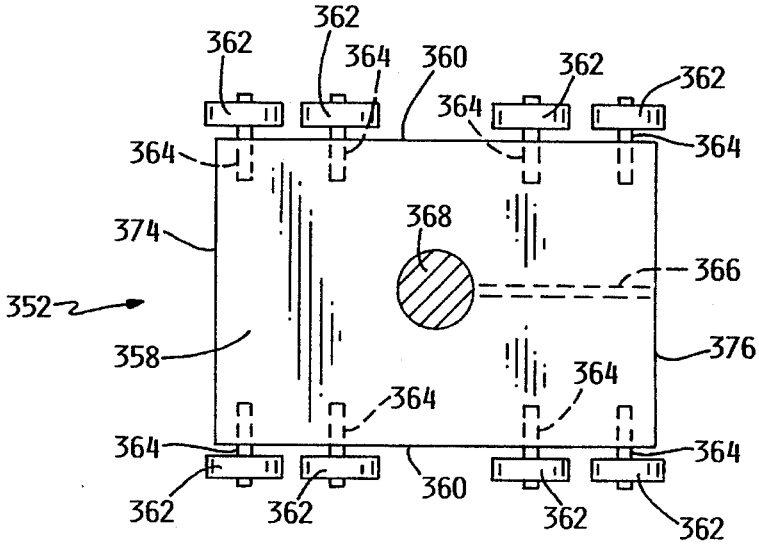
FIG. 39 is an alternate top view of the pillow block depicted in FIGS. 36 and 37.

As may be seen in FIGS. 34–36, a pair of disks 370 or roller bearing means 362 are preferably attached to the pair of opposite surfaces 360 of the pillow block 352 proximate to the first upper surface 356 and the front face 374. An additional pair of disks 370 or roller bearing means 362 are preferably affixed to the pair of opposite surfaces 360 proximate to the rear face 374 and the first lower surface 358. The position and/or combination of disks 370 or roller bearing means 362 as depicted in FIGS. 34–36 may be suitably varied at the discretion of an individual. As depicted in FIGS. 37–39, two pairs of disks 370 or roller bearing means 362 are preferably affixed to the pair of opposite surfaces 360, where one pair is proximate to the front face 374, one pair is proximate to the rear face 376, and both pairs are proximate to the first lower surface 358. An additional two pairs of disks 370 or roller bearing means 362 are affixed to the pair of opposite surfaces 360 of the pillow block 352 proximate to the stem 368 and the first upper surface 356. It should be noted that any combination and location of disks 370 or roller bearing means 362 may be selected by an individual for attachment to the pillow block 352 provided that the essential functions, features, and attributes described herein are not sacrificed.

Figure 40:
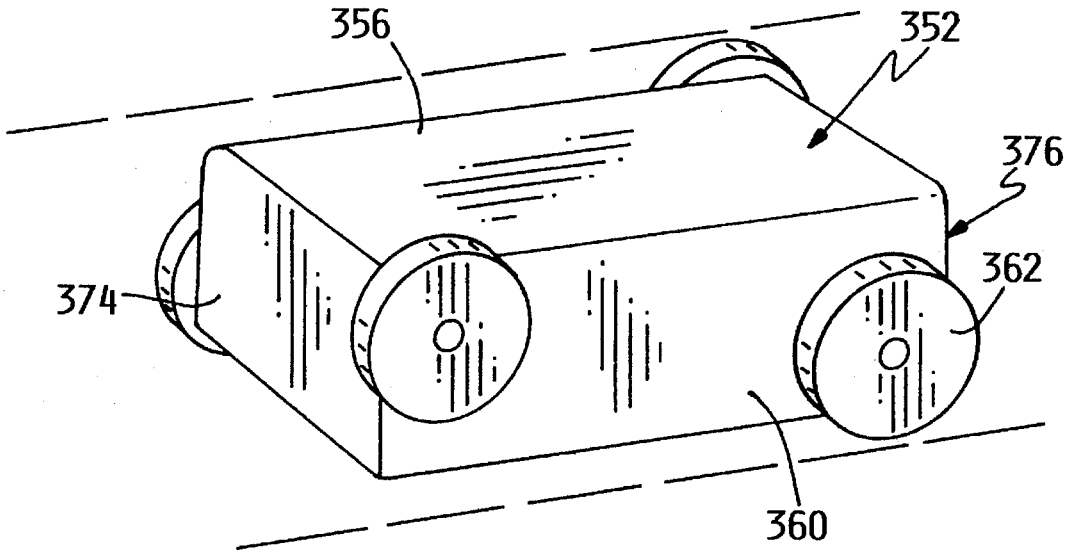
FIG. 40 is an alternative detailed isometric partial phantom line view of a pillow block including roller bearing means positioned at opposite corners.
Figure 41:
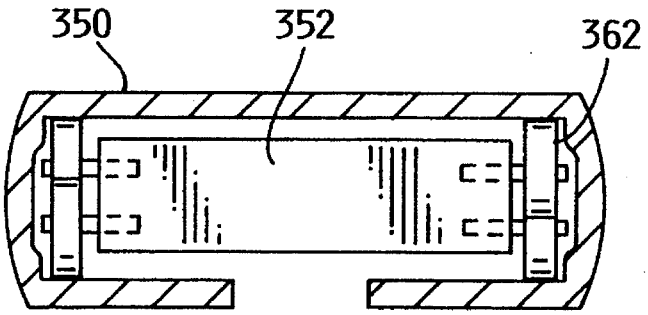
FIG. 41 is an alternative partial cross-sectional end view taken along line 35—35 of FIG. 33.

As may be seen in FIGS. 40 and 41, a pair of disks 370 or roller bearing means 362 are preferably affixed to the opposite surfaces 360 proximate to opposite corners of a pillow block 352 and are further proximate to the first upper surface 356. In addition, a second pair of disks 370 or roller bearing means 362 are preferably affixed to the opposite surfaces 360 proximate to the two remaining opposite corners of the pillow block 352, and are further proximate to the first lower surface 358. The disks 370 or roller bearing means 362 mounted to a pillow block 352 in this configuration engage the interior of a shroud 350 permitting free sliding engagement therebetween regardless of the upward or downward pressure or load being exerted upon, or applied to, the arm rest 354.

It should also be noted that any preferred number of roller bearing means 362 or disks 370 may be selected as preferred by an individual for the provision of the fluid sliding motion between the shroud 350 and the pillow block 352.

The elongate shroud 350 preferably encloses the pillow block 352. The shroud 350 preferably includes a front stop 378 and a rear stop 380. The front stop 378 and rear stop 380 may be integral, or may be affixed to, the shroud 350 as preferred by an individual. It should be noted that any means may be selected by an individual to attach the front stop 378 and rear stop 380 to the shroud 350 including but not limited to the use of machine pressing, welding, screws, adhesives, and or nuts and bolts provided that separation therefrom does not occur during use of the arm support device 10. The shroud 350 preferably also includes an interior top surface 382, an interior bottom surface 384, and an interior pair of side surfaces 386 extending between the interior top surface 382 and the interior bottom surface 384. Each of the interior pair of side surfaces 386 preferably include a longitudinally extending and centrally positioned roller bearing means receiving channel 388 which is adapted to receive roller bearing means 362. The engagement between the roller bearing means 362 and the roller bearing means receiving channels 388 prevent axial rotation of the shroud 350 with respect to the pillow block 352. The roller bearing means receiving channels 388 are preferably positioned adjacent and proximate to the opposite side surfaces 360 of the pillow block 352.

The interior bottom surface 388 preferably includes a centrally positioned and longitudinally extending slot 390. The slot 390 is preferably adapted for passing engagement of the stem 368 during fluid linear motion of the shroud 350 with respect to the pillow block 352. The stem 368 is preferably swingably connected to a standard and base as previously described permitting the pillow block 352 to be swingable and vertically adjustable relative to the base of the arm support device 10.

In this embodiment, the shroud 350 substantially covers the pillow block 352 extending from a position proximate to the front stop 378 to the rear stop 380. The rear stop 380 is preferably positioned rearwardly of the pillow block 352. (FIG. 33) The shroud 350 is preferably formed of extruded aluminum material. The shroud 350 may, however, be formed of any other sturdy material as preferred by of an individual, including but not limited to the use of metals or plastics, provided that fracture or failure does not occur during use of the arm rest 354. The shroud 350 preferably has a cross-sectional shape of an oval. The cross-sectional shape of the shroud 350 may, however, be square or round at the preference of an individual.

The remaining features and functions of the roller bearing means 362 and/or ball bearing arrangements as engaged to the pillow block 352 are preferably identical to the embodiments as earlier described with the exception of the elimination of the necessity of ledges or guides 266 as earlier described.

The shroud 350 is preferably affixed to the pillow block 352 by the positioning of the roller bearing means 362 within the roller bearing means receiving channels 388. Additionally, the interior bottom surface 384, including the slot 390, prevents vertical raising of the shroud 350 with respect to the pillow block 352. The shroud 350 may be machine pressed for engagement to the front stop 378 and rear stop 380 which positions the shroud 350 in a substantially covering relationship over the pillow block 352. Axial rotation of the shroud 350 with respect to the pillow block 352 is thereby prevented. The vertical separation of the shroud 350 from the pillow block 352 is prevented by the engagement between the roller bearing means 362 within the roller bearing means receiving channels 388 and the engagement between the interior bottom surface 384 and the first lower surface 358.

The shroud 350 preferably minimizes the accumulation and/or presence of dust or dirt contamination proximate to the roller bearing means 362. In addition, the shroud 350 preferably minimizes the risk of an individual's clothes and/or arm from being pinched between the roller bearing means 362, pillow block 352, and/or a linear slide as earlier described during use of the arm support device 10. The use of the shroud 350 preferably eliminates the necessity of linear slides or rods 16, 80 as previously described, significantly improving the utility of an arm support device 10 to an individual.

In this embodiment it should be noted that the arm rest 354 may be substantially round in shape including the rotational and tilt functions as earlier described. In addition, the ball bearing arrangement/roller bearing means 362 may be freely substituted at the discretion of an individual to provide for the free flowing linear movement of the shroud 350 with respect to the pillow block 352.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An arm support connectable to an object, comprising:

(a) a base connectable to the object;

(b) an arm rest for engaging at least a portion of an arm; and (c) a pillow block having at least one linear slide, said pillow block confining a plurality of roller bearing means, said roller bearing means engaging a portion of said linear slide for reducing friction generated by said linear slide, said linear slide and said pillow block connectable between said base and said arm rest for sliding said arm rest to and away from said base, said linear slide being swingable relative to said base, said linear slide having a front stop and a rear stop, said pillow block preventing axial rotation of said linear slide, said pillow block further having a standard connected and vertically adjustable to said base whereby a wide range of fluid motion is provided for said arm supported by said arm rest; and (d) a shroud engaged to said front stop and to said rear stop.

2. The arm support according to claim 1, wherein said shroud substantially covers said front stop, said rear stop, said pillow block, and said linear slide.

3. The arm support according to claim 1, said shroud comprising a slot disposed adjacent to, and adapted for, passing engagement of said standard during movement of said slide with respect to said pillow block.

4. The arm support according to claim 1, wherein said shroud is engaged to said front stop and said rear stop by machine pressing.

5. The arm support according to claim 1, wherein said shroud has a substantially oval cross-sectional shape.

6. The arm support of according to claim 1, wherein said shroud is formed of extruded aluminum material.

7. An arm support connectable to an object, comprising:

(a) a base having a vertically adjustable standard connectable to said object;

(b) an arm rest for engaging at least a portion of an arm; and (c) an extension means comprising a linear slide and a pillow block between said base and said arm rest for connection and extension of said arm rest relative to said base, said linear slide being slidable relative to said pillow block, said linear slide having a front stop and a rear stop, said pillow block having a roller bearing means slidably engaging said linear slide whereby a wide range of fluid motion is provided for the arm supported by the arm rest, said pillow block being engaged to said standard whereby said arm support is provided with pivotal and swingable rotation relative to said object; and (d) a shroud engaged to said front stop and to said rear stop.

8. The arm support according to claim 7, wherein said shroud substantially covers said front stop, said rear stop, said pillow block, and said linear slide.

9. The arm support according to claim 7, said shroud comprising a slot disposed adjacent to, and adapted for, passing engagement of said standard during movement of said linear slide with respect to said pillow block.

10. The arm support according to claim 7, wherein said shroud is engaged to said front stop and to said rear stop by a machine pressing.

11. The arm support according to claim 7, wherein said shroud has a substantial oval cross-sectional shape.

12. The arm support according to claim 7, wherein said shroud is formed of extruded aluminum material.

* * * * *

UNITED STATES PATENT AND TRADEMARK OFFICE

CERTIFICATE OF CORRECTION

PATENT NO. : 5,597,207

DATED : January 28, 1997

INVENTOR(S) : Jeffrey D. Bergsten and Donald A. Bergsten

It is certified that error appears in the above-indentified patent and that said Letters Patent is hereby corrected as shown below:

Column 8, line 62, delete "m" and insert - - to - -.

Column 8, line 64, delete "m" and insert - - to - -.

Column 9, line 22, delete "m" and insert - - to - -.

Signed and Sealed this

Twentieth Day of May, 1997

*Attest:*

Bruce Lehman

BRUCE LEHMAN

*Attesting Officer*

*Commissioner of Patents and Trademarks*